US009601857B2

(12) United States Patent
Gutierrez et al.

(10) Patent No.: US 9,601,857 B2
(45) Date of Patent: Mar. 21, 2017

(54) METHODS AND APPARATUS FOR TERMINATING WIRE WOUND ELECTRONIC DEVICES

(71) Applicant: Pulse Electronics, Inc., San Diego, CA (US)

(72) Inventors: Aurelio Gutierrez, Bonita, CA (US); Dave Wicka, Escondido, CA (US)

(73) Assignee: PULSE ELECTRONICS, INC., San Diego, CA (US)

( * ) Notice: Subject to any disclaimer, the term of this patent is extended or adjusted under 35 U.S.C. 154(b) by 70 days.

(21) Appl. No.: 14/285,529

(22) Filed: May 22, 2014

(65) Prior Publication Data

US 2014/0349525 A1 Nov. 27, 2014

Related U.S. Application Data

(60) Provisional application No. 61/826,908, filed on May 23, 2013.

(51) Int. Cl.

| | |
|---|---|
| ***H01R 24/00*** | (2011.01) |
| ***H01R 13/405*** | (2006.01) |
| ***H01R 9/24*** | (2006.01) |
| ***H01R 43/20*** | (2006.01) |
| ***H01R 43/28*** | (2006.01) |
| ***H01R 13/66*** | (2006.01) |
| ***H01R 24/64*** | (2011.01) |
| ***H01R 25/00*** | (2006.01) |

(52) U.S. Cl.

CPC ..... *H01R 13/405* (2013.01); *H01R 9/24* (2013.01); *H01R 13/6658* (2013.01); *H01R 24/64* (2013.01); *H01R 25/006* (2013.01); *H01R 43/20* (2013.01); *H01R 43/28* (2013.01); *Y10T 29/49174* (2015.01)

(58) Field of Classification Search

CPC . H01R 23/025; H01R 23/005; H01R 13/6658
USPC .... 439/676, 620.11, 620.17, 620.18, 620.21, 439/620.23

See application file for complete search history.

(56) References Cited

U.S. PATENT DOCUMENTS 4,125,216 A 11/1978 Ozimec
4,956,694 A 9/1990 Eide
(Continued)

*Primary Examiner* — Hae Moon Hyeon
(74) *Attorney, Agent, or Firm* — Gazdinski & Associates, PC

(57) ABSTRACT

An exemplary connector insert assembly, and methods of manufacture and use thereof. In one embodiment, the connector insert assembly comprises an insert body assembly consisting of two insert body elements made from a high-temperature polymer. The insert body assembly includes an electronic component receiving cavity that is configured to receive any number of electronic components, including without limitation, chip chokes and wire wound electronic components. The insert body assembly includes a wire termination feature that includes termination slots that position the wire ends of the wire wound electronic components adjacent to a substrate to which the wire ends are ultimately to be secured. The wire ends are then secured to the substrate using, for example, a mass termination technique. The aforementioned connector insert assembly can then be inserted into a single or multi-port connector assembly. Methods of manufacturing the aforementioned single or multi-port connector assemblies are also disclosed.

18 Claims, 19 Drawing Sheets

(56) References Cited

U.S. PATENT DOCUMENTS 5,015,981 A 5/1991 Lint
5,307,041 A 4/1994 Kato
5,496,195 A 3/1996 Reed
5,587,884 A 12/1996 Raman
5,656,985 A 8/1997 Lu et al.
5,986,894 A 11/1999 Lint et al.
6,005,463 A 12/1999 Lint et al.
6,149,050 A 11/2000 Lai et al.
6,297,721 B1 10/2001 Lu et al.
6,319,064 B1 11/2001 Belopolsky et al.
6,395,983 B1 5/2002 Gutierrez
6,534,726 B1 3/2003 Okada et al.
6,585,540 B2 7/2003 Gutierrez et al.
6,593,840 B2 7/2003 Morrison et al.
6,638,112 B1 * 10/2003 Walker ..... H01R 24/64 439/620.19
6,729,906 B1 5/2004 Simmons et al.
6,752,664 B2 * 6/2004 Hyland ..... H01R 13/6658 439/620.05
6,811,442 B1 11/2004 Lien et al.
6,962,511 B2 11/2005 Gutierrez et al.
6,986,684 B1 1/2006 Lien
7,241,181 B2 * 7/2007 Machado ..... H01R 13/514 439/541.5
7,246,434 B1 7/2007 Taylor et al.
7,314,387 B1 * 1/2008 Liu ..... H01R 13/6633 439/620.11
7,367,851 B2 5/2008 Machado et al.
7,507,914 B2 3/2009 Levine et al.
7,524,206 B2 * 4/2009 Gutierrez ..... H01R 24/64 439/607.01
7,843,300 B2 * 11/2010 Wang ..... H01F 27/027 336/192
8,206,183 B2 6/2012 Machado et al.
8,535,100 B2 9/2013 Ge et al.
8,591,262 B2 11/2013 Schaffer et al.
8,911,257 B2 12/2014 Kang et al.
8,911,527 B2 12/2014 Ferrer et al.
9,130,315 B2 * 9/2015 O'Malley ..... H01R 13/6469
2001/0032740 A1 10/2001 Kennedy et al.
2003/0186586 A1 10/2003 Gutierrez et al.
2006/0009061 A1 1/2006 Machado et al.
2010/0015852 A1 * 1/2010 Xu ..... H01R 13/514 439/620.09
2012/0154087 A1 6/2012 Chen
2013/0288526 A1 10/2013 Rascon et al.
2014/0154920 A1 6/2014 Dinh et al.
2015/0011126 A1 * 1/2015 Zhou ..... H01R 13/646 439/620.21

* cited by examiner

300

METHODS AND APPARATUS FOR TERMINATING WIRE WOUND ELECTRONIC DEVICES

PRIORITY

This application claims the benefit of priority to co-owned U.S. Provisional Patent Application Ser. No. 61/826,908 of the same title filed May 23, 2013, the contents of which are incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present disclosure relates generally to electronic components, and particularly in one exemplary aspect to an improved design and method of securing electronic components, such as within a single- or multi-connector assembly.

DESCRIPTION OF RELATED TECHNOLOGY

Modular connectors are commonly used in the telecommunications industry for Ethernet applications and telephone jacks among others. Originally, modular connectors were used with registered jack (RJ) systems. The connectors are typically of female gender and usually called sockets. The male connectors are typically called plugs. The modular connectors (and plugs) adhere to the Telecommunications Industry Association/Electronic Industries Alliance Commercial Building Telecommunications Cabling Standard Set ("TIA/EIA-568-B") standardization and in addition to electrical connection may be performing signal conditioning functions such as voltage transformation and electrical noise filtering.

Some of the considerations for effective manufacturing include (i) cost as a function of scalable and automated manufacturing capability (ii) compliance with TIA/EIA-568-B standards; (iii) footprint of the connectors and plugs; (iv) electrical conductivity and noise performance characteristics; (v) reliability of the connectors; (vi) ability to configure the connector for plurality of industry operations such as Internet Protocol ("IP") networking and conducted telecommunications (vii) simplified manufacturing methods providing for highly effective and automated manufacturing.

The aforementioned factors have resulted in myriad different (and often highly specialized) configurations for modular connectors in the prior art. Many of these designs utilize an internal printed circuit board ("PCB") or substrate for carrying electronic or signal conditioning components internal to the connector housing. For example, U.S. Pat. No. 7,241,181 to Machado et al. and entitled "Universal Connector Assembly and Method of Manufacturing", incorporated herein by reference in its entirety, discloses, in one exemplary embodiment, insert assemblies for use within an electrical connector. These insert assemblies include a cavity that house choke coils and transformers. The wires from these choke coils and transformers are then in one variant wire wrapped and soldered to terminals present on the insert assembly in order to facilitate the signal conditioning function of these choke coils and transformers within the electrical connector. However, each of the transformers and choke coils present within this electrical connector has three (3) to four (4) windings with upwards of six hundred and ninety six (696) wire terminations, which may have to be manually wrapped around terminals and soldered (which can be a very time consuming process contributing greatly to the overall cost of the connector assembly).

Accordingly, it would be desirable to provide, inter alia, an improved electrical connector (e.g., modular jack) design that would provide reliable and superior electrical and noise performance, while allowing for low cost manufacturing. Ideally, such a solution would eliminate the need to manually wrap and hand solder these windings to these terminations, in order to avoid the lengthy time and associated cost of these highly manual manufacturing processes. Furthermore, such a solution would also improve the reliability of the soldered terminations, thereby avoiding costly rework manufacturing processes.

SUMMARY

The present disclosure satisfies the foregoing needs by providing, inter alia, an improved electrical connector assembly which is produced via manufacturing techniques at a substantially lower cost than is present in the prior art.

In one aspect, a multi-port connector assembly is disclosed. In one embodiment, the multi-port connector assembly includes a connector housing having a plurality of recesses that are each adapted to receive at least a portion of a modular plug having a plurality of conductors disposed thereon. The multi-port connector assembly further includes in one variant sets of conductors disposed at least partly within respective ones of the recesses and adapted to interface electrically with respective ones of the modular plug conductors. The multi-port connector assembly also includes a removable insert structure having a plurality of termination grooves with respective conductive ends of one or more electronic components disposed substantially in the termination grooves. The conductive ends of the one or more electronic components are held within the termination grooves via the securing of a substrate adjacent to the grooves. The conductor ends of the one or more electronic components interface with respective ones of the modular plug conductors to form an electrical pathway from the conductors to the one or more electronic components.

In a second aspect, a single port connector assembly is disclosed.

In a third aspect, connector insert assemblies useful for the aforementioned single and multi-port connector assemblies are disclosed.

In a fourth aspect, methods of manufacturing the aforementioned single and multi-port connector assemblies are disclosed.

In a fifth aspect, methods of manufacturing the aforementioned connector insert assemblies for the single or multi-port connector assemblies are disclosed.

BRIEF DESCRIPTION OF THE DRAWINGS

The features, objectives, and advantages of the present disclosure will become more apparent from the detailed description set forth below when taken in conjunction with the drawings, wherein.

DETAILED DESCRIPTION

Figure 1:
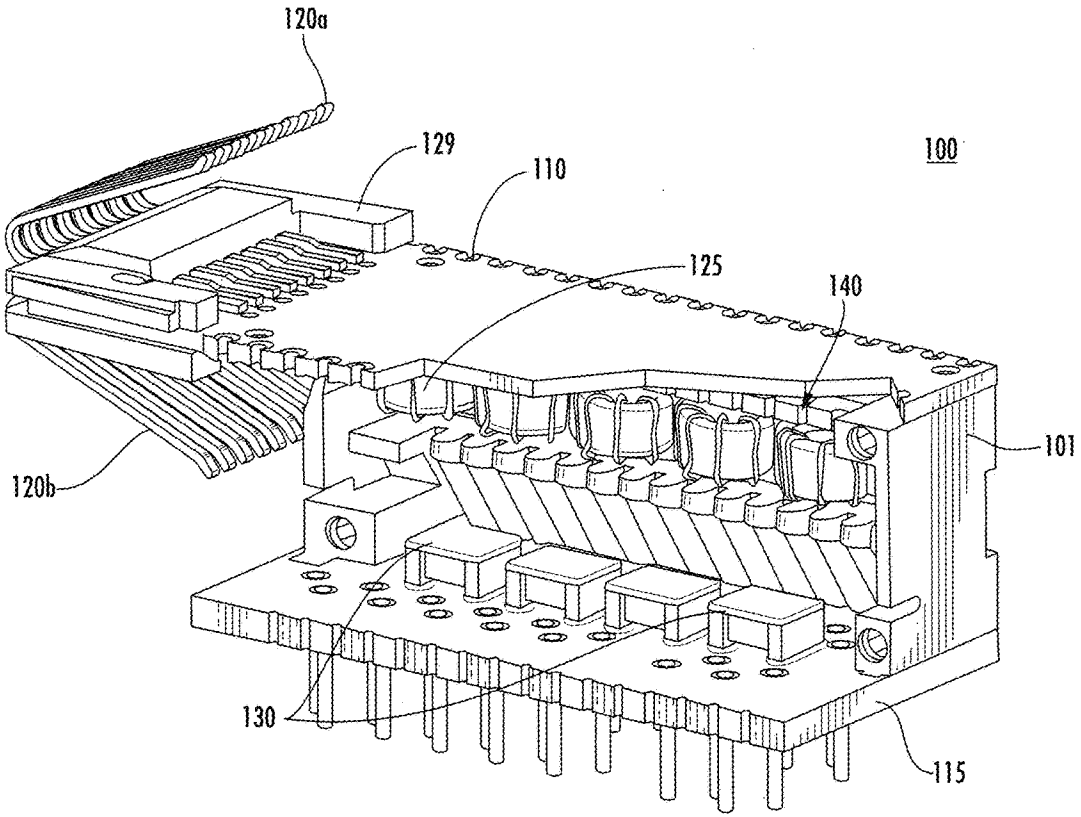
FIG. 1 is a perspective view of a first exemplary embodiment of a connector insert assembly according to the principles of the present disclosure.

Reference is now made to the drawings wherein like numerals refer to like parts throughout.

It is noted that while the following description is cast primarily in terms of a plurality of RJ-type connectors and associated modular plugs of the type well known in the art, the present invention may be used in conjunction with any number of different connector types. Accordingly, the following discussion of the RJ connectors and plugs is merely exemplary of the broader concepts.

As used herein, the terms "electrical component" and "electronic component" are used interchangeably and refer to components adapted to provide some electrical function, including without limitation inductive reactors ("choke coils"), transformers, filters, gapped core toroids, inductors, capacitors, resistors, operational amplifiers, and diodes, whether discrete components or integrated circuits, whether alone or in combination.

As used herein, the term "signal conditioning" or "conditioning" shall be understood to include, but not be limited to, signal voltage transformation, filtering, current limiting, sampling, processing, and time delay.

As used herein, the term "port pair" refers to an upper and lower modular connector (port) which are in a substantially over-under arrangement; i.e., one port disposed substantially atop the other port, whether directly or offset in a given direction.

As used herein, the term "interlock base" refers generally to, without limitation, a structure such as that disclosed in U.S. Pat. No. 5,015,981 to Lint, et al. issued May 14, 1991 entitled "Electronic microminiature packaging and method", U.S. Pat. No. 5,986,894 to Lint, et al. issued Nov. 16, 1999 entitled "Microelectronic component carrier and method of its manufacture", U.S. Pat. No. 6,005,463 to Lint, et al. issued Dec. 21, 1999 entitled "Through-hole interconnect device with isolated wire-leads and component barriers", U.S. Pat. No. 6,395,983 to Gutierrez issued May 28, 2002 entitled "Electronic packaging device and method", or U.S. Pat. No. 6,593,840 to Morrison, et al. issued Jul. 15, 2003 entitled "Electronic packaging device with insertable leads and method of manufacturing", each of the foregoing incorporated herein by reference in its entirety.

Overview

The present disclosure provides, inter alia, exemplary configurations of a connector insert assembly. In one embodiment, the connector insert assembly comprises an insert body assembly consisting of two insert body elements made from a high-temperature polymer. The insert body assembly includes an electronic component receiving cavity that is configured to receive any number of electronic components, including without limitation, chip chokes and wire wound electronic components.

The insert body assembly includes a wire termination feature that includes termination slots that position the wire ends of the wire wound electronic components adjacent to a substrate to which the wire ends are ultimately to be secured. In one embodiment, the termination slots are disposed immediately adjacent the aforementioned substrate such that the substrate positions and secures the wire ends. The wire ends are then secured to the substrate using, for example, a mass termination technique. Alternatively, a separate component is disposed adjacent the substrate and holds the wire ends of the wire wound electronic components so that the wire ends can be positioned and secured to the adjacent substrate. This separate component can then be removed and subsequently reused during subsequent manufacturing operations.

The aforementioned connector insert assembly can then be inserted into a single or multi-port connector assembly.

Methods of manufacturing the aforementioned connector insert assemblies and single or multi-port connector assemblies are also disclosed.

Connector Insert Assembly

Figure 1A:
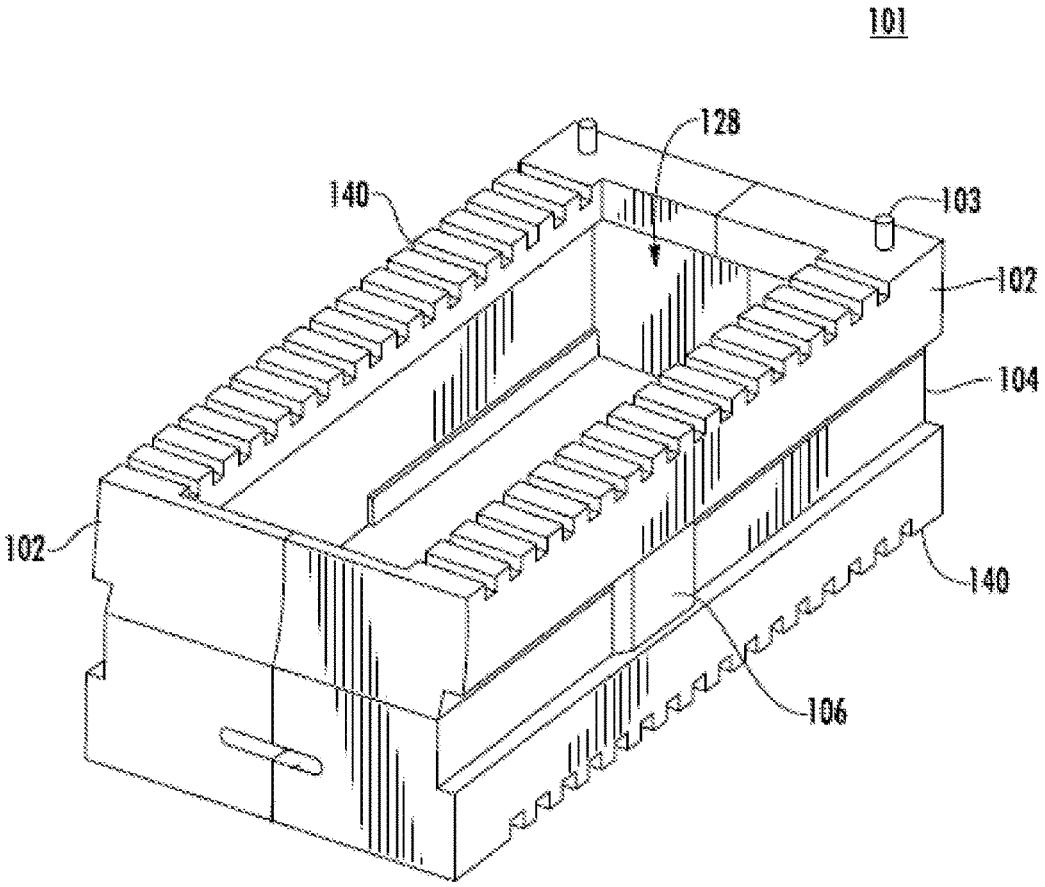
FIG. 1A is a perspective view of the header body elements of the connector insert assembly shown in FIG. 1.
Figure 1B:
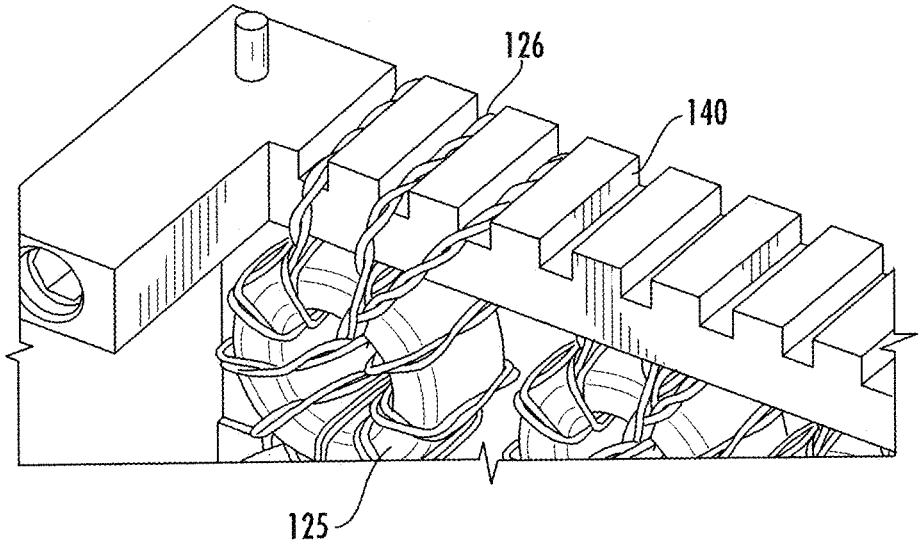
FIG. 1B is a perspective view of the header body elements of FIG. 1A with wire ends of various electronic components routed therein in accordance with an exemplary embodiment of the present disclosure.
Figure 1C:
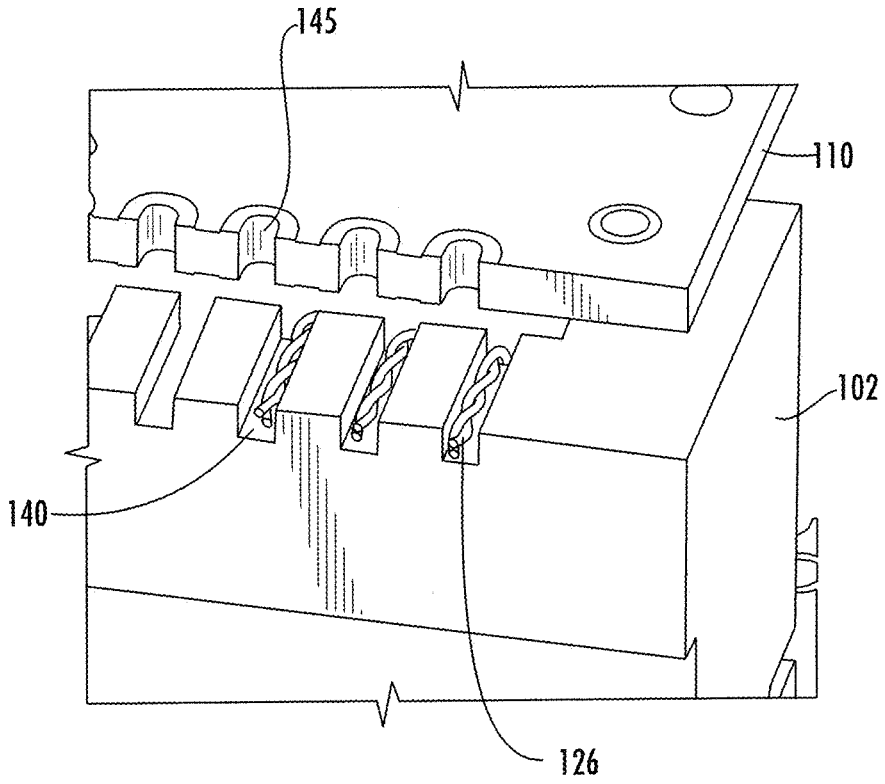
FIG. 1C is a perspective view of the wire routed header body elements of FIG. 1B illustrated just prior to being secured to a printed circuit board.
Figure 1D:
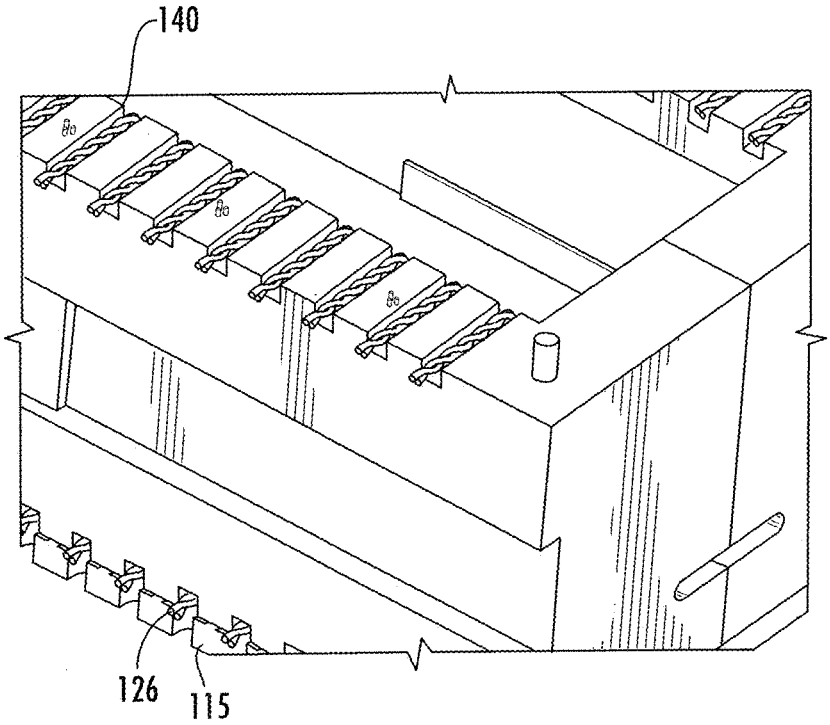
FIG. 1D is a perspective view of the header body elements of FIG. 1A with wire ends of various electronic components routed therein in accordance with one embodiment of the present disclosure.
Figure 1E:
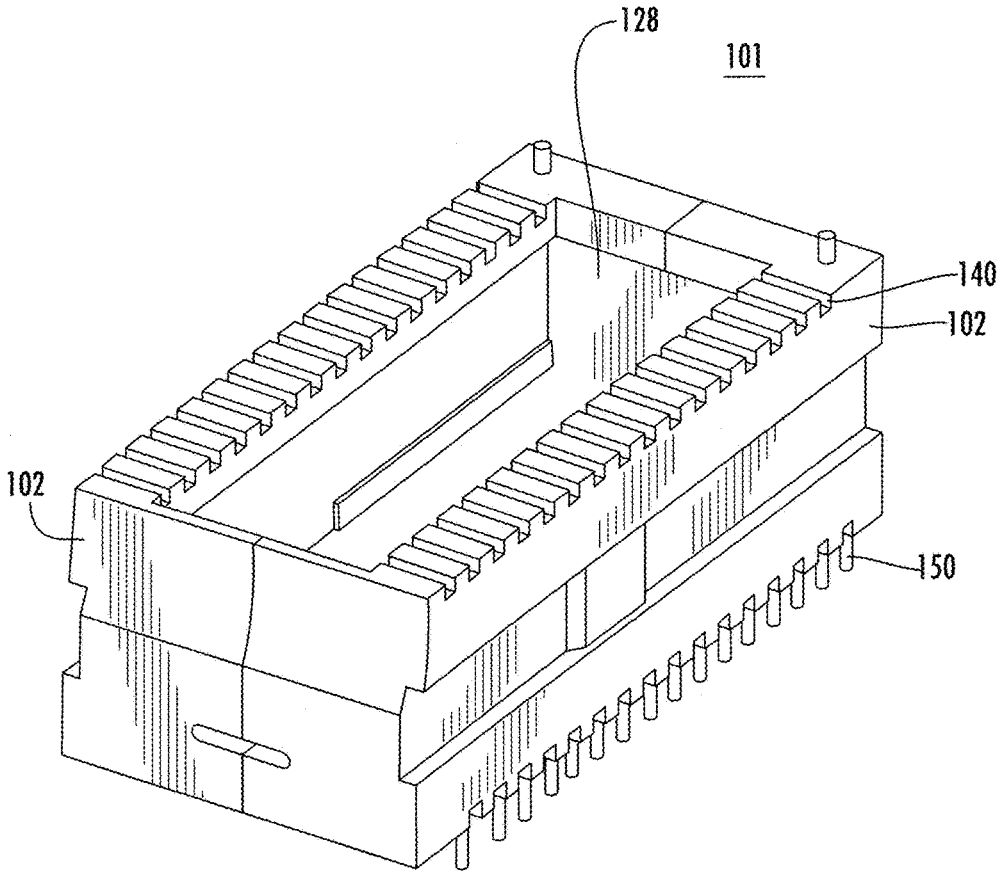
FIG. 1E is a perspective view of an alternative embodiment of a header body element according to the principles of the present disclosure.

Referring now to FIGS. 1-1E, exemplary configurations of a connector insert assembly are shown and described in detail. FIG. 1 is a cross-section view of an exemplary connector insert assembly 100. The connector insert assembly shown in FIGS. 1-1E is configured to be received within a connector housing 302 of a connector assembly 300 as shown in, for example, FIG. 3. The general use of connector insert assemblies within a single or multi-port connector assembly is known and is described, for example, in co-owned U.S. Pat. No. 7,241,181 filed Jun. 28, 2005 and entitled "Universal Connector Assembly and Method of Manufacturing", the contents of which are incorporated herein by reference in its entirety, although it will be appreciated that this configuration is merely exemplary, and others may readily be used consistent with the disclosure.

Referring again to FIG. 1, the connector insert assembly embodiment illustrated includes an upper substrate 110, as well as a lower substrate 115 with an insert body assembly 101, or interlock base, positioned between the upper and lower substrates. It will be appreciated that the terms "upper" and "lower" as used herein are meant in a completely relative sense, and are not in any way limiting or indicative of any preferred orientation. For example, where the connector insert assembly is installed on the underside of a substantially horizontal motherboard, the "upper" terminals would actually be disposed below the "lower" terminals. The upper and lower substrates are, in an exemplary embodiment, secured to the insert body assembly via an interference fit between posts located on the insert body assembly and holes contained within the upper and lower substrates. As an alternative, or in addition to the interference fit posts, solderable terminals are inserted into the insert body assembly and the upper and lower substrates are subsequently soldered to these solderable terminals. In one exemplary implementation, a minimum of four (4) copper terminals are insert molded into the underlying insert body assembly and are generally positioned at the four (4) corners of the insert body assembly. These copper terminals will hold the substrates temporarily until they are permanently soldered to both the top and bottom substrates during the wire termination solder operation. This wire termination solder operation may utilize one or more industry standard processing practices such as solder dipping, heated iron solder, laser solder, solder paste in combination with a reflow oven, solder wave, selective solder wave, etc. Alternatively, the substrates can be secured to the insert body assembly via an adhesive, such as an epoxy, encapsulant, or yet other suitable substance or mechanism.

Positioned on the upper substrate is a terminal insert assembly 129 comprised of an upper terminal insert assembly and lower terminal insert assembly. The mounting of the terminal insert assemblies to the upper substrate is described in, for example, co-owned U.S. Pat. No. 7,241,181 filed Jun. 28, 2005 and entitled "Universal Connector Assembly and Method of Manufacturing", the contents of which were previously incorporated by reference in its entirety. The lower substrate 115 has, in the illustrated embodiment, four (4) chip choke assemblies 130 disposed thereon. These chip choke assemblies comprise, in an exemplary embodiment, the chip choke assemblies described in co-owned and co-pending U.S. Patent Provisional Application Ser. No. 61/732,698 filed Dec. 3, 2012 and entitled "Choke Coil Devices and Methods of Making and Using the Same", the contents of which is incorporated herein by reference in its entirety.

Positioned adjacent to the upper and lower substrates is a pair of insert body elements (102, FIG. 1A) which collectively forms insert body assembly 101. While the insert body assembly 101 is illustrated as being composed off of a pair of insert body elements, it is appreciated that more (i.e. three (3) or more) or less (i.e. one (1)) insert body element embodiments are envisioned herein. The insert body elements illustrated in FIG. 1 collectively form a cavity that is configured to house the chip choke assemblies disposed on the lower substrate as well as a number of wire wound electronic components 125 (e.g. wound toroids).

Referring now to FIG. 1A, the illustrated insert body assembly 101 consists of two insert body elements 102 generally made from a high-temperature polymer (e.g., a liquid crystal polymer (LCP)) and preferably formed by an injection molding process. The insert body assembly of FIG. 1A differs from that shown in FIG. 1, as the insert body assembly of FIG. 1 is for use with one or more chip choke assemblies while the embodiment shown in FIG. 1A is configured specifically for use with wound toroidal chokes. The insert body assembly includes an electronic component cavity 128 that is configured to receive any number of electronic components, including the aforementioned chip chokes and toroid wire wound electronic components. In an exemplary embodiment, the wire wound electronic components included within the cavity 128 comprise wound toroids. Although not illustrated with features that conform to the inserted electronic components, the cavity can incorporate toroidal molded shapes so as aid in the positioning of the coils within the electronic component receiving cavity in an alternative embodiment. The use of electronic component receiving cavities which are shaped to accommodate the electronic components received therein are described in co-owned U.S. Pat. No. 5,015,981 issued on May 14, 1991 and entitled "Electronic Microminiature Packaging and Method", the contents of which are incorporated herein by reference in its entirety.

On the top surface of each of the illustrated embodiment of the insert body elements 102 are substrate positioning posts 103 which are formed from the underlying injection molded polymer. The insert body assembly 101 also includes a lateral groove 104 that is formed on the side surfaces of each of the insert body elements and is configured for mating with respective features (e.g., a projection) on the connector housing 302 (FIG. 3A). The lateral groove also includes an engagement feature 106 configured for mating with a respective feature of the connector housing. The lateral groove in combination with the engagement features are adapted to position and mechanically lock the insert body assembly within the connector housing. Located on the top surface of the illustrated insert body elements are termination slots 140 which are used to terminate the wire wound electronic components to the upper and/or lower substrates. The termination slots 140 will be discussed in additional detail with respect to FIGS. 1B-1D.

Referring now to FIGS. 1B-1D, the exemplary wire termination feature of the present disclosure is shown and described in detail. FIG. 1B illustrates a detailed view of the termination slots 140 present on the top surface of the insert body elements with wire ends 126 from a wound electronic component 125 disposed therein. The depth of each of these termination slots is sized to accommodate the wire ends 126 of the wound electronic component. For example, in an embodiment where four (4) wires are configured to be accommodated in one termination slot and each wire has a diameter of five mils (0.005 inches), the wires are twisted together such that they create a twisted wire end bundle having a twelve mil (0.012 inch) maximum diameter. In such a proposed configuration, the slot width and depth will each be approximately twenty mils (0.020 inches). Such a configuration enables the termination slot, and associated substrate, to secure the bundled wire ends prior to termination to the substrate. While a four (4) wire embodiment comprised of five mil (0.005 inches) wire is described herein, it is appreciated that other wire configurations and/or wire sizes could be readily substituted with appropriate modification of the termination slot dimensions, such modification being within the skill of the ordinary artisan given this disclosure.

Referring now to FIG. 1C, another detailed view of the termination slots 140 of the insert body is illustrated with the wire ends 126 positioned within these termination slots. Prior to inserting the wire ends within these terminations slots, in an exemplary embodiment, the insulation should be first removed from the wire ends. The removal of the insulation can be accomplished using any number of known insulation removal techniques including for instance via laser ablation after assembly, a solder dip of the termination ends prior to assembly or by a solder dipping process which removes the insulation during termination of the wire ends to each of the substrates. The upper substrate 110 is positioned above insert body element with the plated terminations 145 of the upper substrate aligned so as to match up with respective termination slots. In one exemplary embodiment, the substrate is screen printed with a eutectic solder paste. The substrate is then mechanically secured to the insert body elements with the wire ends of the wound electronic components positioned within the termination slots and adjacent to the screen printed substrate(s). The screen printed solder paste is then heated (e.g., in a solder reflow oven) and the screen printed solder paste melts and bonds with the underlying wire ends thereby securing the wire ends from the wire wound electronic components to the substrate.

In an alternative embodiment, the substrate is not screen printed with a solder paste; rather the substrate is merely mechanically positioned over the termination slots as shown in FIG. 1C. The substrate acts to fix the wire ends within the termination slots. The resultant assembly is subsequently mass terminated, such as via a wave soldering or a selective solder fountain methodology. The process of holding/positioning the wires after they are arranged in the termination slot can be accomplished using a separate assembly fixture or by appropriate form or fit design within the insert body assembly itself. Referring now to FIG. 1D, after securing the wire ends 126 to one of the substrates (here the bottom substrate 115), the wire ends for the other side of the insert body assembly 101 are positioned within respective termination slots 140 and subsequently soldered to an adjacent substrate (i.e., the upper substrate in the illustrated embodiment).

The exemplary slotted termination method illustrated in FIGS. 1B-1D is advantageous over prior art methods, in that the insert body assembly 101 is less costly to manufacture, as the insert body assembly does not require or limits the number of post-inserted or insert molded pins. Additionally, such a configuration also requires less manufacturing labor to produce (along with the resultant costs associated with this manufacturing labor) due to the fact that it eliminates the wire wrapping methodologies required in the prior art.

Referring now to FIG. 1E, an alternative embodiment of an insert body assembly 101 consisting of two insert body elements 102 generally made from a high-temperature polymer and formed by an injection molding process is illustrated. Similar to the embodiment shown in FIG. 1A, the insert body assembly includes an electronic component receiving cavity 128 that is configured to receive any number of wire wound and non-wire wound electronic components. Also included on the top surface of the insert body elements 102 are optional substrate positioning posts 103 as well as termination slots 140 which are used to terminate the wire wound electronic components to the upper and/or lower substrates. However, unlike the embodiment illustrated in FIG. 1A, the insert body elements further includes a plurality of insert molded or post-inserted terminals 150 positioned on the underside of the insert body elements. The utilization of the terminals 150 is discussed below with respect to FIG. 1F.

Figure 1F:
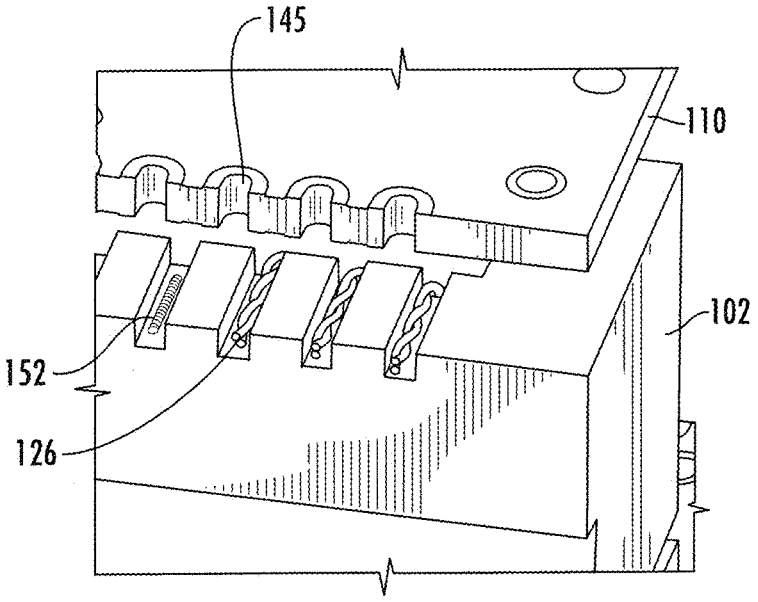
FIG. 1F is a perspective view of the wire routed header body elements of FIG. 1E illustrated just prior to being secured to a printed circuit board.

Referring now to FIG. 1F, a detailed view of the termination slots 140 illustrated in FIG. 1E is shown and described in detail. Specifically, positioned within each of the termination slots are the termination ends 152 of the terminals 150 shown in FIG. 1E. As shown, each of these terminals is insert-molded or post inserted within insert body elements 102 such that a top portion of the terminals remains exposed within the insert body element termination slots. The wire ends 126 are then positioned over the termination ends and sandwiched between the substrate 110 and the insert body element. In one exemplary embodiment, the substrate is solder dipped or soldered using, for example, a selective solder fountain to secure the wire ends to the substrate and to the termination ends of the terminals simultaneously. The substrate is then mechanically secured to the insert body elements with the wire ends of the wound electronic components positioned within the termination slots over the termination ends. In an alternative embodiment, a screen printing process is used such that the screen printed solder paste is heated (e.g., in a solder reflow oven) and the screen printed solder paste melts and bonds with the underlying wire ends.

In an alternative embodiment, the substrate is not screen printed with a solder paste; rather the substrate is merely mechanically positioned over the termination slots as shown in FIG. 1F. The substrate acts to fix the wire ends within the termination slots. The resultant assembly is subsequently mass terminated, such as via the aforementioned wave soldering methodology.

Figure 2A:
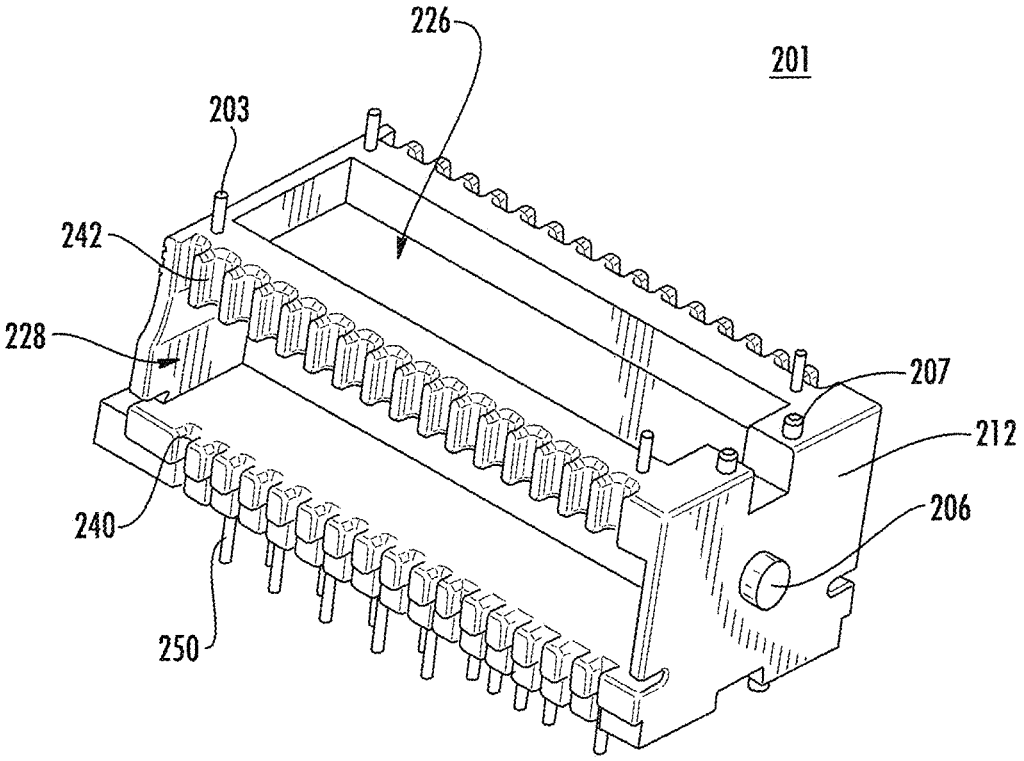
FIG. 2A is a perspective view of an alternative embodiment of a header body element according to the principles of the present disclosure.
Figure 2B:
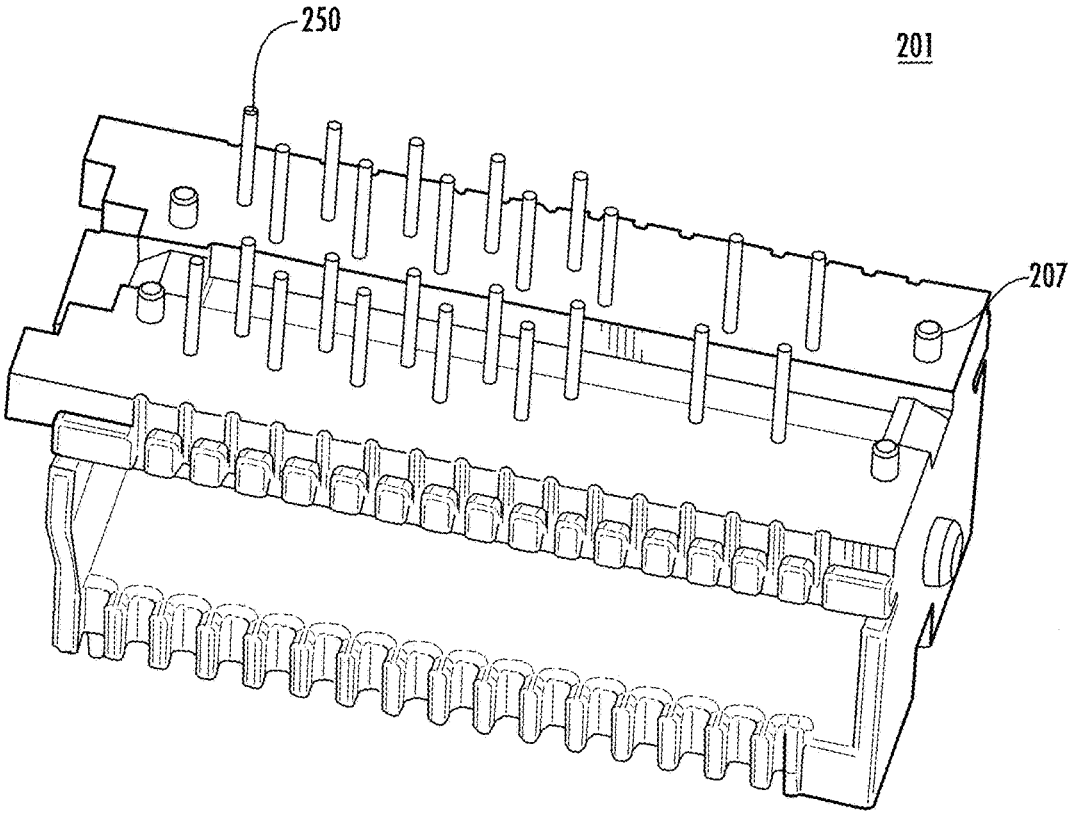
FIG. 2B is a perspective view of the underside of the header body element shown in FIG. 2A.
Figure 2C:
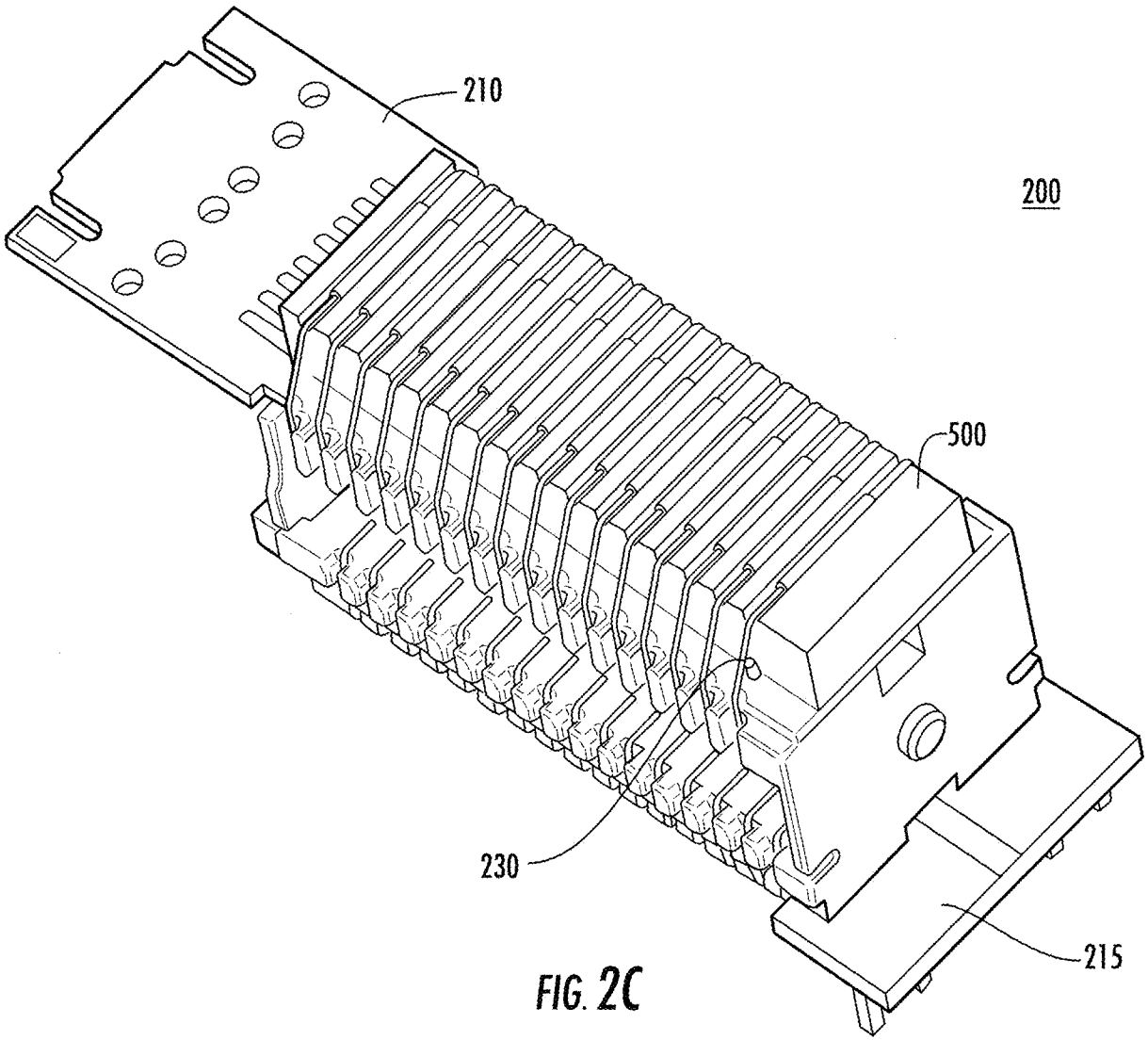
FIG. 2C is a perspective view of an alternative embodiment of a connector insert assembly in combination with a solder cover, according to the principles of the present disclosure.

Referring now to FIGS. 2A-2E, an alternative configuration of a connector insert assembly is shown and described in detail. FIG. 2A illustrates a perspective view of a header body element 201 manufactured in accordance with the principles of the present disclosure. The embodiment illustrated in FIG. 2A differs substantially from that shown in, for example, FIG. 1A in that the connector insert assembly is formed from a single piece of an insert molded or post inserted polymer header 212. The header body element includes a number of cavities including a wire wound electronic component receiving cavity 228, as well as an electronic component receiving cavity 226 adapted to accommodate electronic components located on the underside of the upper substrate as shown in FIG. 2C (210).

Positioned adjacent the wire wound electronic component receiving cavity 228 are a plurality of termination slots 240, 242. The upper termination slots 242 are configured to route the wire ends from a wire wound electronic component (e.g. a toroid-shaped transformer or wire-wound choke coil) to an upper substrate while the lower termination slots 240 are configured to route the wire ends from a wire wound electronic component to a lower substrate. However, unlike the embodiment illustrated with respect to FIGS. 1-1F, the wire ends are not sandwiched between the substrate and the termination slots. In the illustrated embodiment, the header body element includes four (4) solderable alignment posts 203 on a top surface of the header body element as well as two (2) larger diameter alignment posts 207 that are configured to properly position the upper substrate with respect to the header body element. The terminal pins 250 located on the underside of the header body element are configured to properly position the lower substrate with respect to the header body element. In addition, the header body element includes a back post 206 which helps to align the header body element within the body of the connector housing (see, e.g., FIGS. 3-3E discussed below).

Referring now to FIG. 2B, the underside of the header body element 201 shown with respect to FIG. 2A is illustrated. Specifically, the relative positioning of the terminal pins 250 is shown along with four (4) alignment posts 207 which help to facilitate the positioning of the lower substrate as discussed supra. Furthermore, while a specific configuration is shown for the terminal pins 250, it is appreciated that any number of different terminal pin configurations such as those shown in U.S. Pat. No. 7,241,181 issued on Jul. 10, 2007 and entitled "Universal Connector Assembly and Method of Manufacturing"; and U.S. Pat. No. 6,962,511 issued on Nov. 8, 2005 and entitled "Advanced Microelectronic Connector Assembly and Method of Manufacturing", the contents of each of the foregoing being incorporated herein by reference in its entirety, can be readily substituted.

Referring now to FIG. 2C, the termination of the wire ends 230 to the upper substrate 210 is shown and described in detail. Specifically, the upper substrate 210 is positioned on top of the header body element and the wire ends from wire wound electronic components located within the cavity of the header body element are routed into respective termination slots and secured to a temporary cover 500. The cover 500 is preferably manufactured using a high temperature polymer that is designed to protect, for example, surface mount electronic components (see FIG. 2D, 260) located on the upper substrate during the termination process. The cover is intended to be reusable on the manufacturing production line for the connector insert assembly 200. The wire ends 230 are secured to the upper substrate 210 via a soldering process (e.g. solder dipping) and are subsequently cut via either a manual or automated process. Such a configuration is desirable in that it enables repeatable solder connections as well as automation with respect to wire trimming and cover removal. While discussed with respect to the upper substrate 210, it is appreciated that a similar process can also be performed for securing the wire ends to the lower substrate 215.

Furthermore, it is appreciated that the upper substrate 210 and the techniques for providing signal paths to the electromagnetic interference (EMI) shield, and ultimately ground, for the upper substrate, our described in commonly owned and co-pending U.S. patent application Ser. No. 13/797,527 filed Mar. 12, 2013 and entitled "Shielded Integrated Connector Modules and Assemblies and Methods of Manufacturing the Same", the contents of which are incorporated herein by reference in its entirety. Additionally, the lower substrate 215 is, in an exemplary embodiment, comprised of a substrate shield as described in co-owned U.S. Pat. No. 6,585,540 issued on Jul. 1, 2003 and entitled "Shielded Microelectronic Connector Assembly and Method of Manufacturing", the contents of which are incorporated herein by reference in its entirety.

Figure 2D:
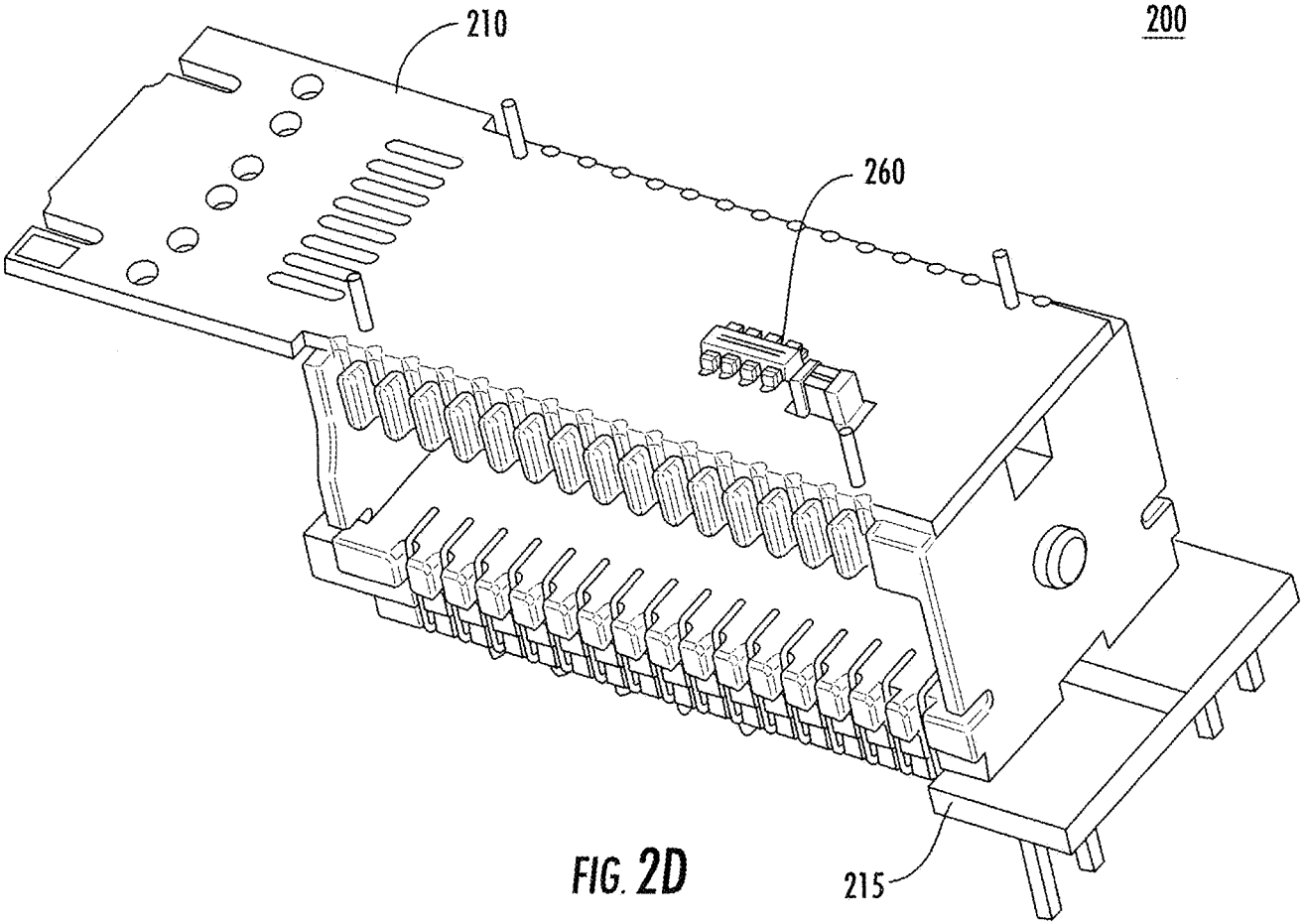
FIG. 2D is a perspective view of the connector insert assembly of FIG. 2C with the solder cover removed from view.

Referring now to FIG. 2D, the cover is shown removed from view from the connector insert assembly 200. Specifically, the upper substrate 410 is illustrated with a plurality of surface mounted electronic components 260 positioned on a surface thereof. Although not explicitly shown, it is appreciated that the surface mounted electronic components are disposed on signal pathways that are in electrical communication with one or more wire wound electronic components disposed within the wire wound electronic component receiving cavity.

Figure 2E:
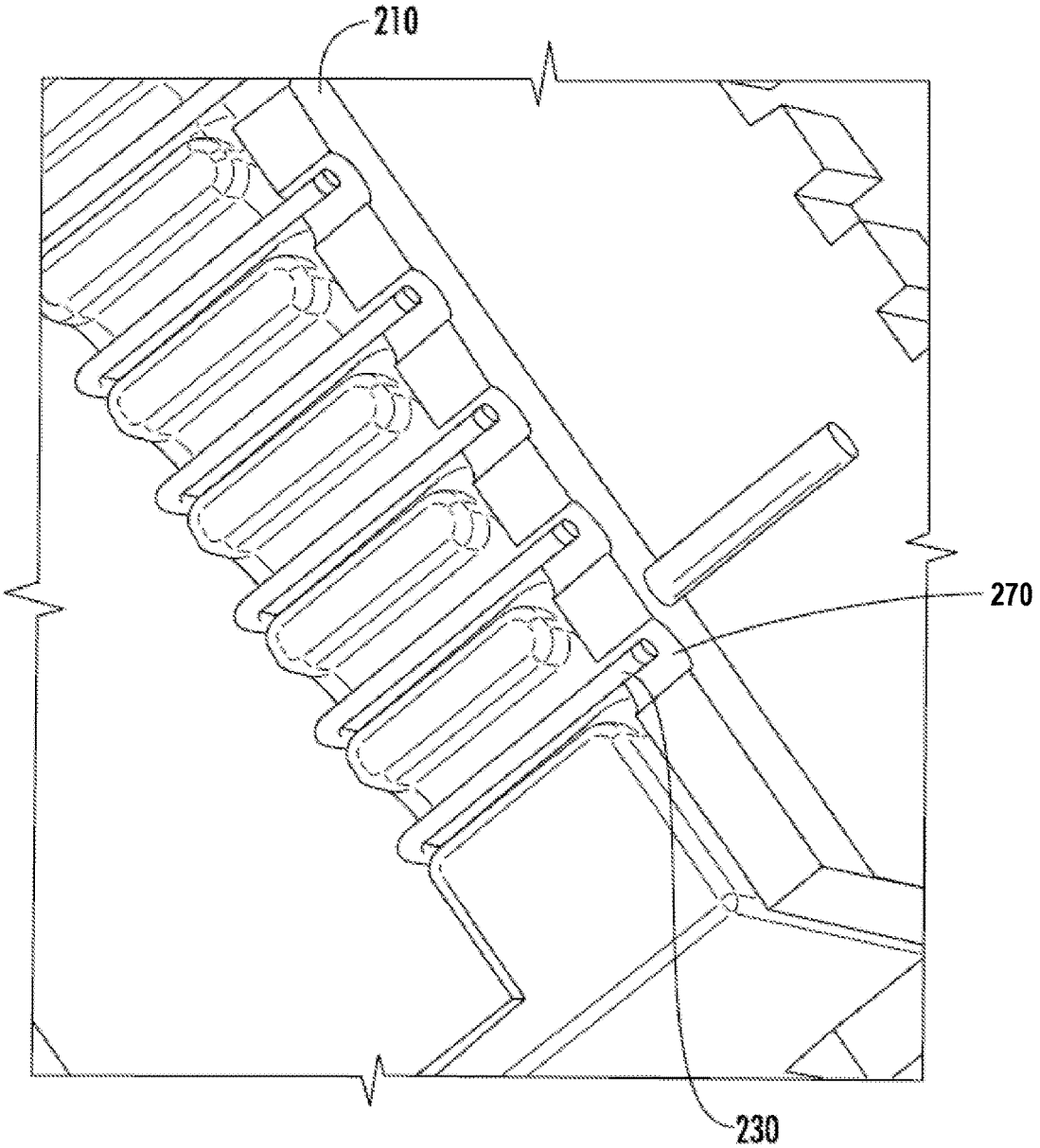
FIG. 2E is a detailed perspective view of the soldered terminations of the connector insert assembly as shown in FIG. 2D.

FIG. 2E illustrates a detailed view the wire ends 230 terminated to the upper substrate 210 at soldered terminations 270 via the termination grooves. Specifically, the upper substrate contains a plurality of half-moon shaped termination disposed on an external surface for the upper substrate. The wire ends 230 are terminated within respective ones of the half-moon shaped terminations. As discussed previously herein, the wire ends are terminated via the use of a eutectic solder connection.

Multi-port Embodiment

Figure 3:
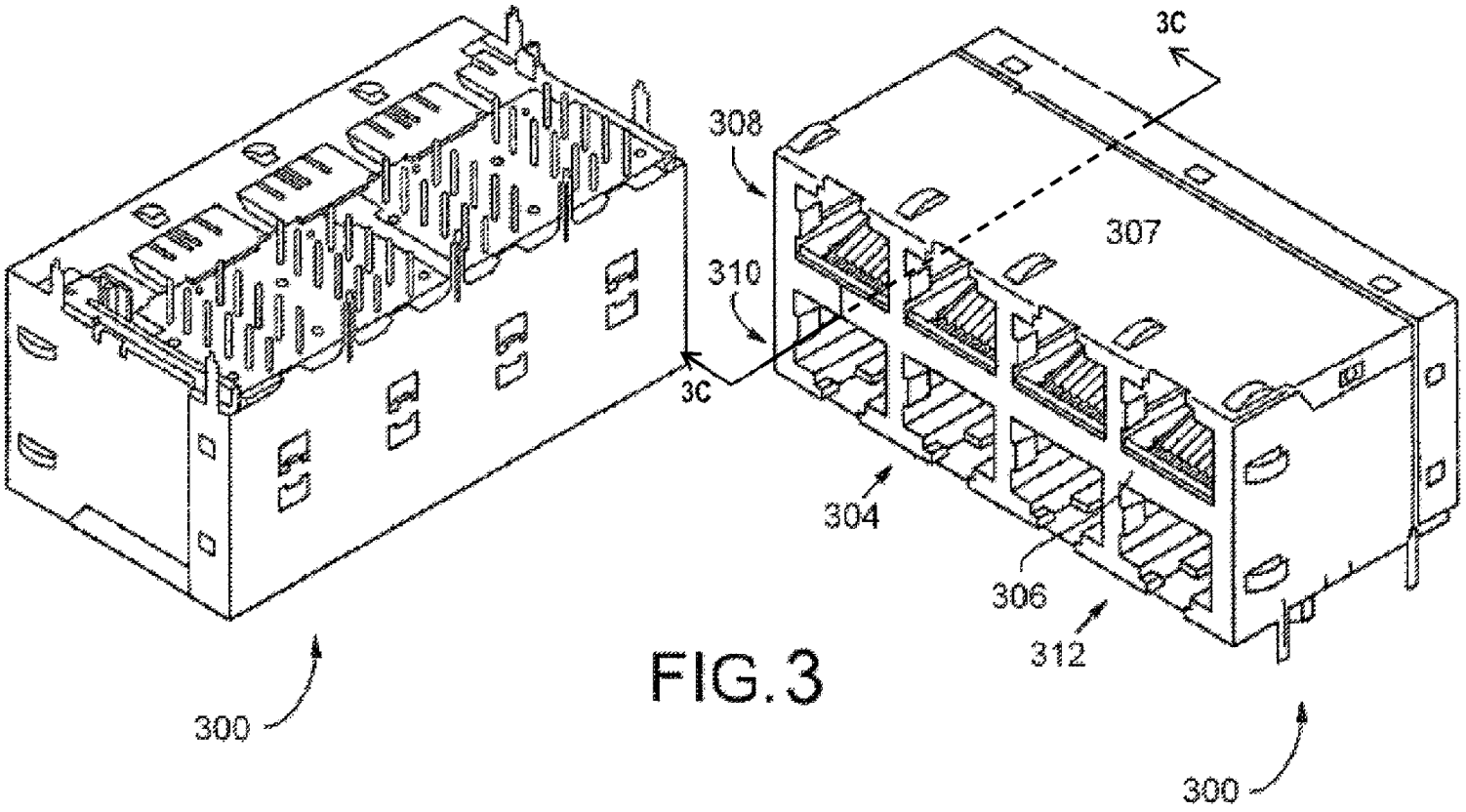
FIG. 3 shows front and back perspective views of a first exemplary embodiment (shielded 2×4, for Gigabit Ethernet or GBE) of the connector assembly according to the present disclosure.
Figure 3A:
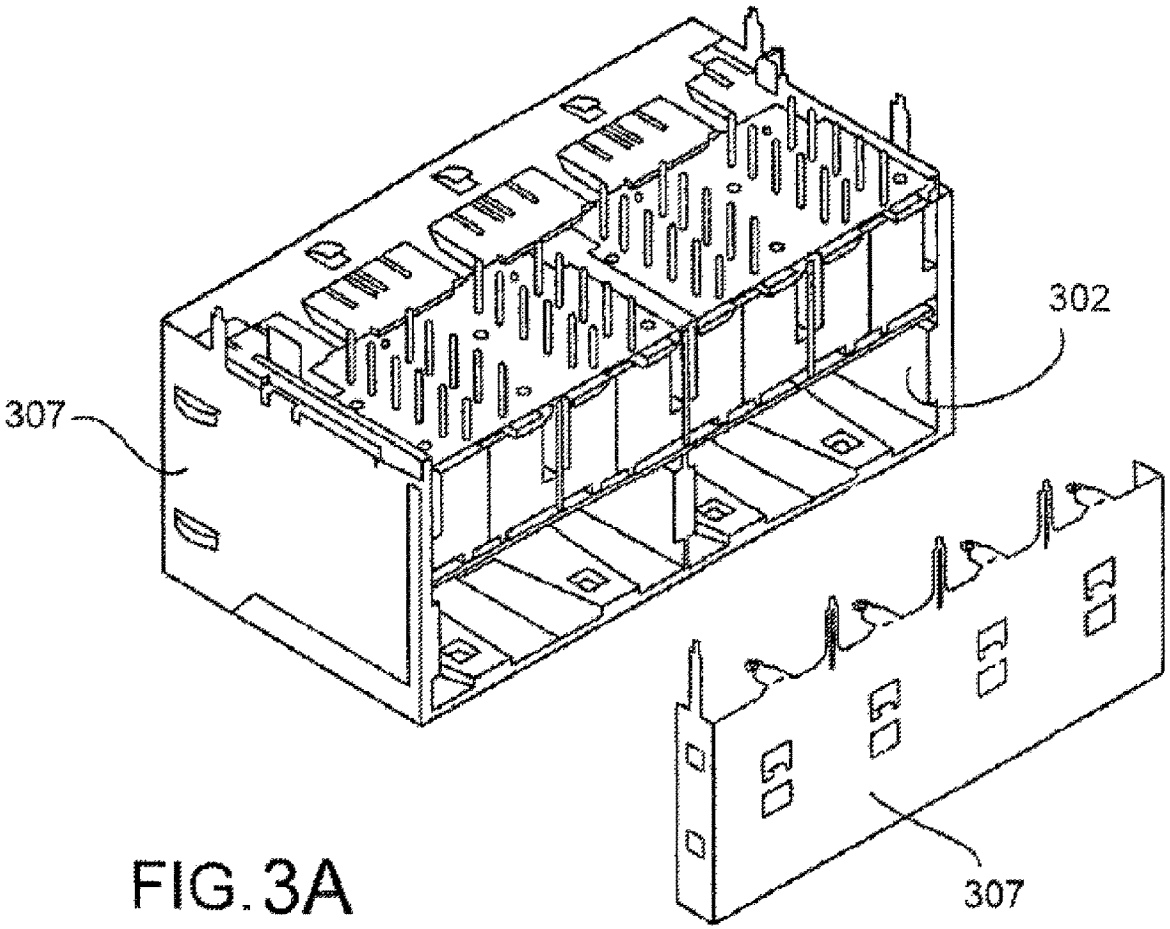
FIG. 3A is a rear perspective view of the connector assembly of FIG. 3, showing the rear shield removed.
Figure 3B:
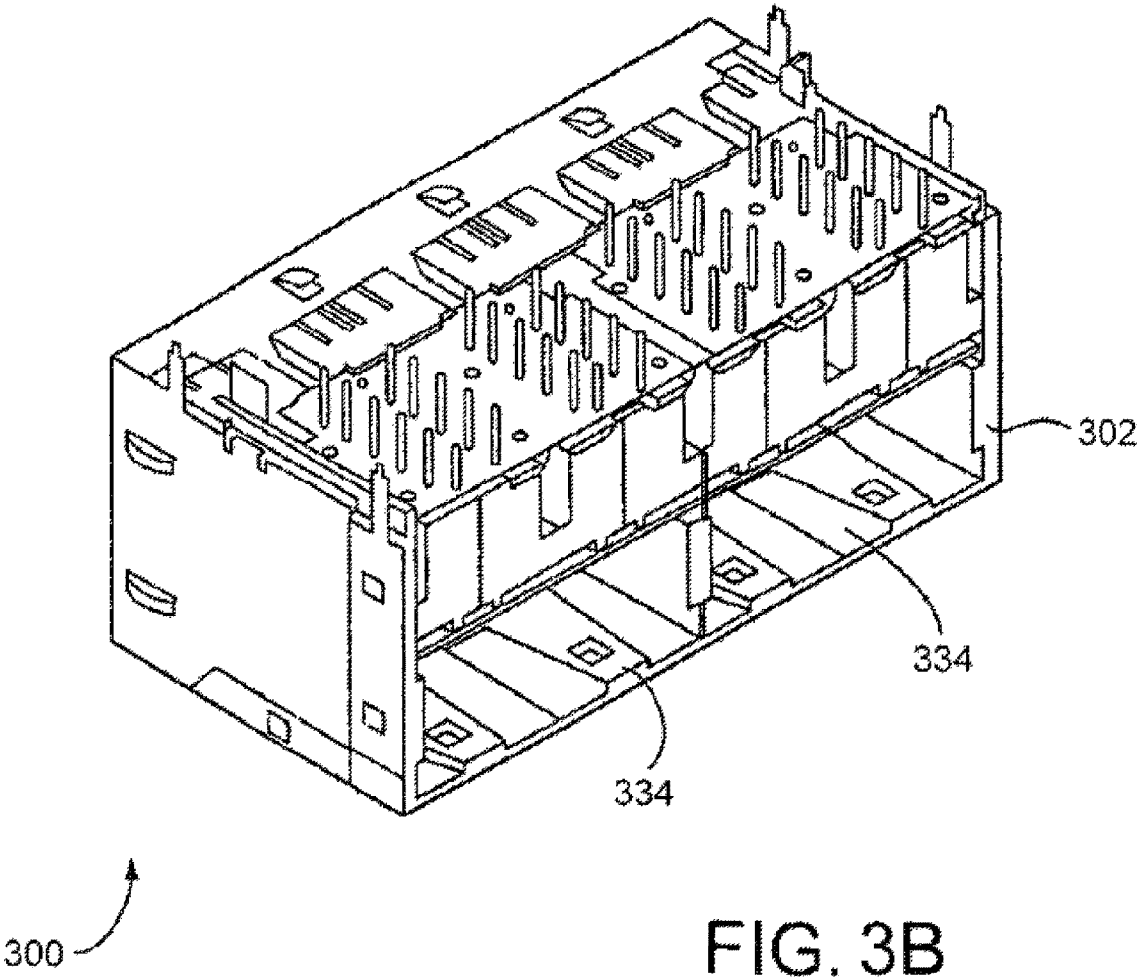
FIG. 3B is a rear perspective view of the connector assembly of FIG. 3, showing the relationship between the shield and the lower substrate.
Figure 3C:
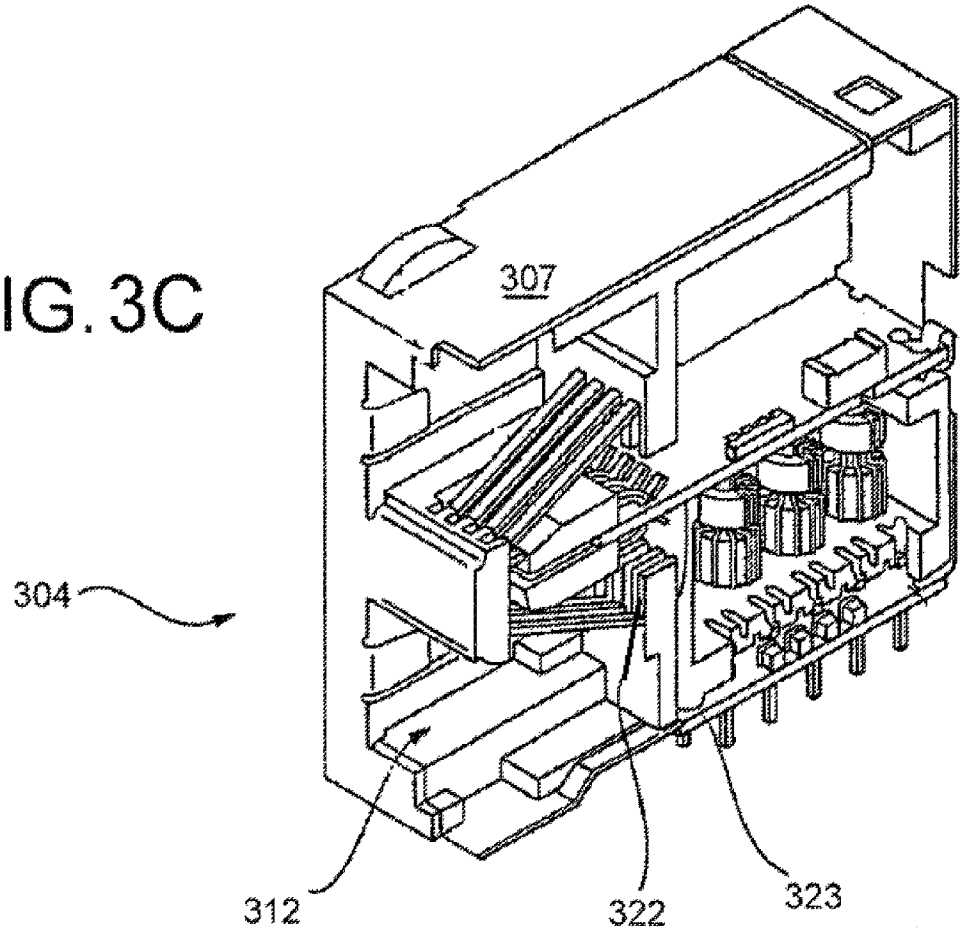
FIG. 3C shows side perspective cutaway views of the connector assembly according to FIG. 3, taken along line 3C-3C.
Figure 3D:
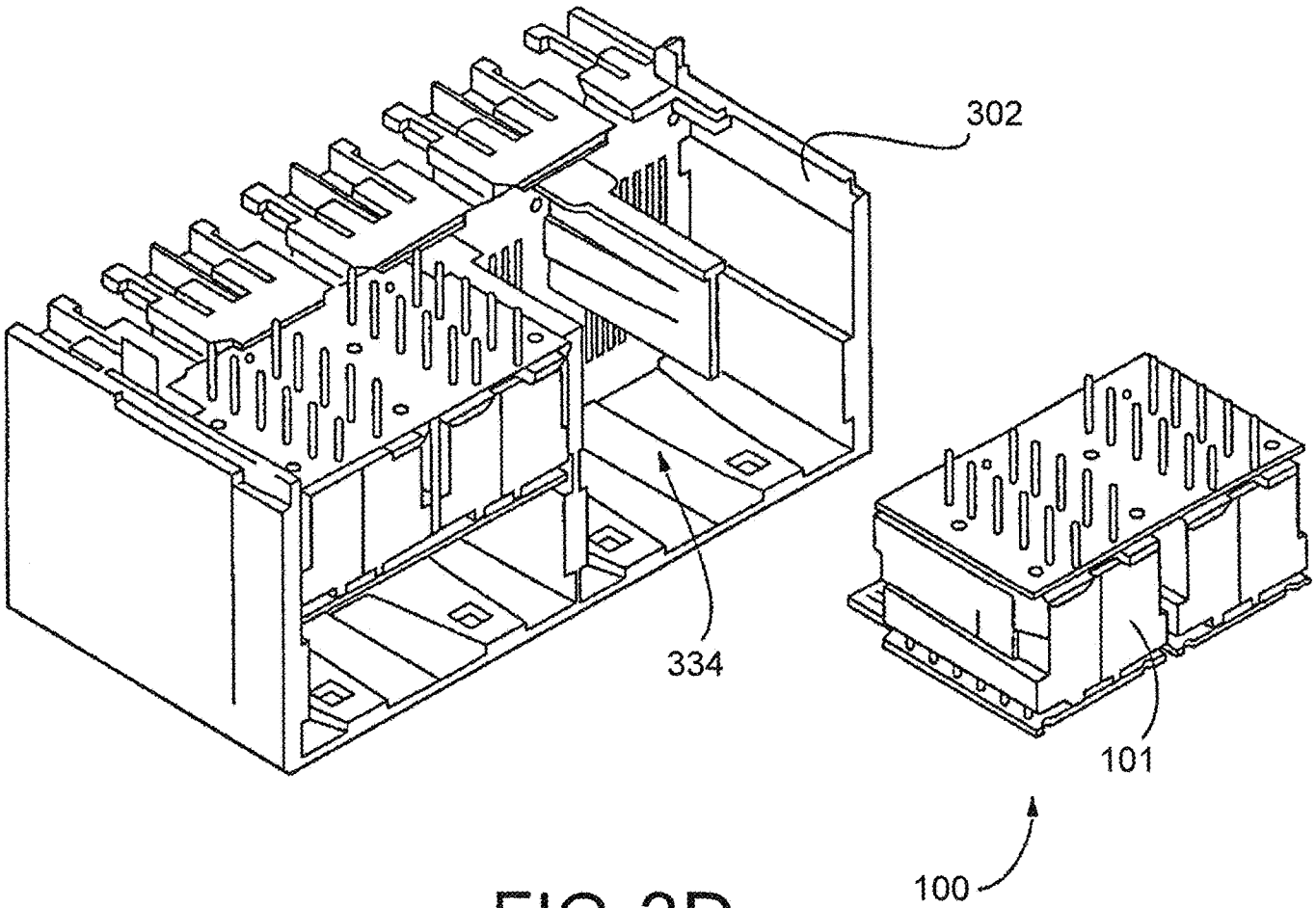
FIG. 3D is a rear perspective view of the connector assembly of FIG. 3, showing one insert assembly removed.
Figure 3E:
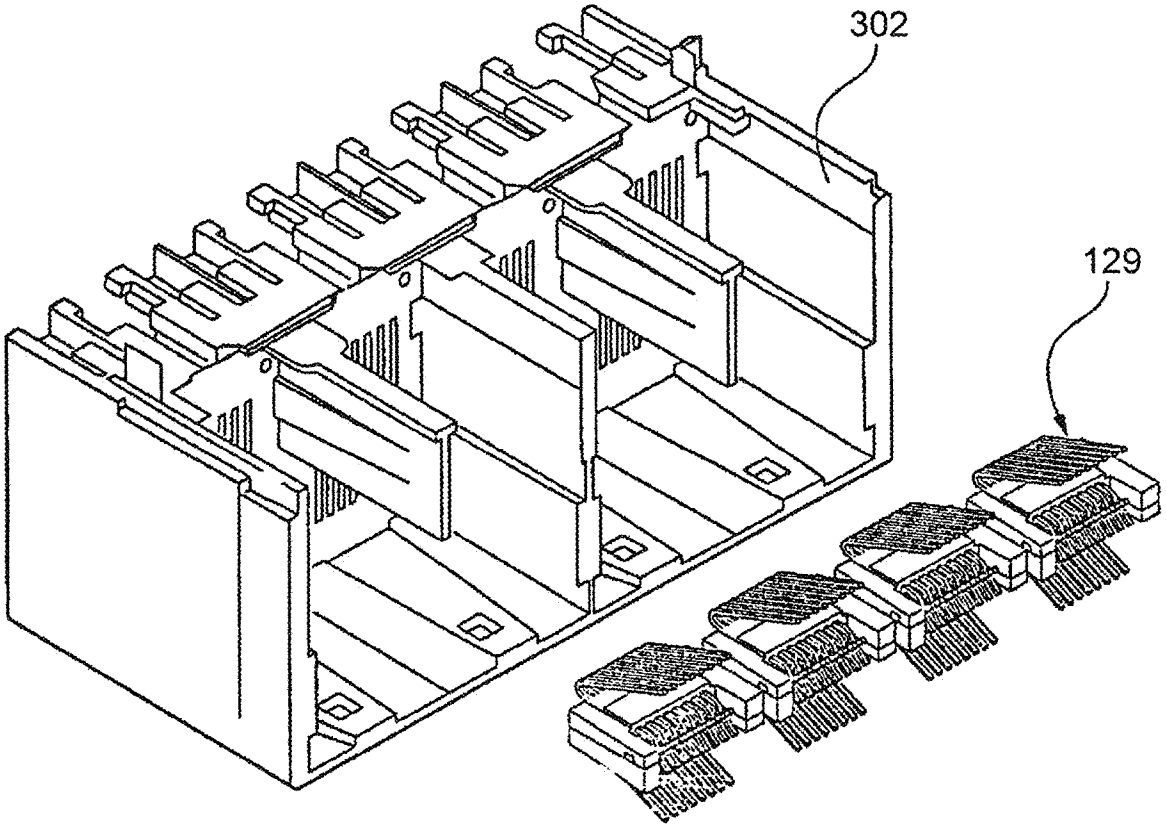
FIG. 3E is a rear perspective view of the housing element of the connector assembly of FIG. 3, showing the terminal insert assemblies removed and various housing element details.

Referring now to FIGS. 3-3E, a first embodiment of the connector assembly for use with the insert body assembly of FIGS. 1-1F and 2-2E of the present disclosure is shown and described in detail. Specifically, and as shown in FIG. 3, the assembly 300 generally comprises a connector housing 302 having a plurality of individual connectors 304 formed therein. Specifically, the connectors 304 are arranged in the illustrated embodiment in side-by-side row fashion within the housing 302 such that two rows 308, 310 of connectors 304 (i.e. port pairs) are formed, one disposed atop the other ("row-and-column"). The front walls 306 of each individual connector 304 are further disposed parallel to one another and generally coplanar, such that modular plugs may be inserted into the plug recesses 312 formed in each connector 304 simultaneously without physical interference. The plug recesses 312 are each adapted to receive one modular plug (not shown) having a plurality of electrical conductors disposed therein in a predetermined array, the array being so adapted to mate with respective conductors 120*a* and 120*b* present within in each of the plug recesses 312 thereby forming an electrical connection between the plug conductors and connector conductors as described in greater detail below.

The rows 308, 310 of the embodiment of FIG. 3 are oriented in mirror-image fashion, such that the latching mechanism for each connector 304 in the top row 308 is reversed or mirror-imaged from that of its corresponding connector in the bottom row 310. This approach allows the user to access the latching mechanism (in this case, a flexible tab and recess arrangement of the type commonly used on RJ modular jacks, although other types may be substituted) of both rows 308, 310 with a minimal degree of physical interference. It will be recognized, however, that the connectors within the top and bottom rows 308, 310 may be oriented identically with respect to their latching mechanisms, such as having all the latches of both rows of connectors disposed at the top of the plug recess 312, if desired. The connector housing element 302 is in the illustrated embodiment electrically non-conductive and is formed from a thermoplastic (e.g. Thermx® polycyclohexylene dimethylene terephthalate (PCT), infrared (IR) compatible, the UL 94 Standard for Safety of Flammability of Plastic Materials for Parts in Devices and Appliances testing, classification V-0 (UL94V-0)), although it will recognized that other materials, polymer or otherwise, may conceivably be used. An injection molding process is used to form the housing 302, although other processes may be used, depending on the material chosen. The selection and manufacture of the housing element is well understood in the art, and accordingly will not be described further herein.

As shown in FIGS. 3A and 3B, the connector assembly may also be shielded with, inter alia, an external tin or alloy noise (i.e. electromagnetic interference (EMI)) shield 307 of the type well known in the connector arts. A plurality of grooves 322 which are disposed generally parallel and oriented vertically within the housing 302 are formed generally within the plug recess 312 of each connector 304 in the housing element 302. The grooves 322 are spaced and adapted to guide and receive the aforementioned conductors 120 that are used to mate with the conductors of the modular plug. The conductors 120 are formed in a predetermined shape and held within one of a plurality of conductor or terminal insert assemblies 129 each formed from, for example, two (2) sub-assemblies, the latter also being received within the housing element 302 as shown in FIG. 3C. Specifically, the housing element 302 includes a plurality of cavities 334 formed in the back of respective connectors 304 generally adjacent to the rear wall of each connector 304 and extending forward into proximity of the recesses 312, each cavity 334 being adapted to receive the terminal insert assemblies 129. The first conductors 120*a* of the substrate/component assemblies 129 are deformed such that when the assemblies 129 are inserted into their respective cavities 334, the upper conductors 120*a* are received within the grooves 322, maintained in position to mate with the conductors of the modular plug when the latter is received within the plug recess 312, and also maintained in electrical separation by the separators 323 disposed between and defining the grooves 322. When installed, the respective terminal inserts 129 are in a substantially juxtaposed arrangement (see e.g., FIG. 3E). Each cavity is further adapted to receive an electronics insert assembly 100 of the type generally shown and described with respect to FIGS. 1-1F and FIGS. 2A-2E.

Method of Manufacture

Figure 4:
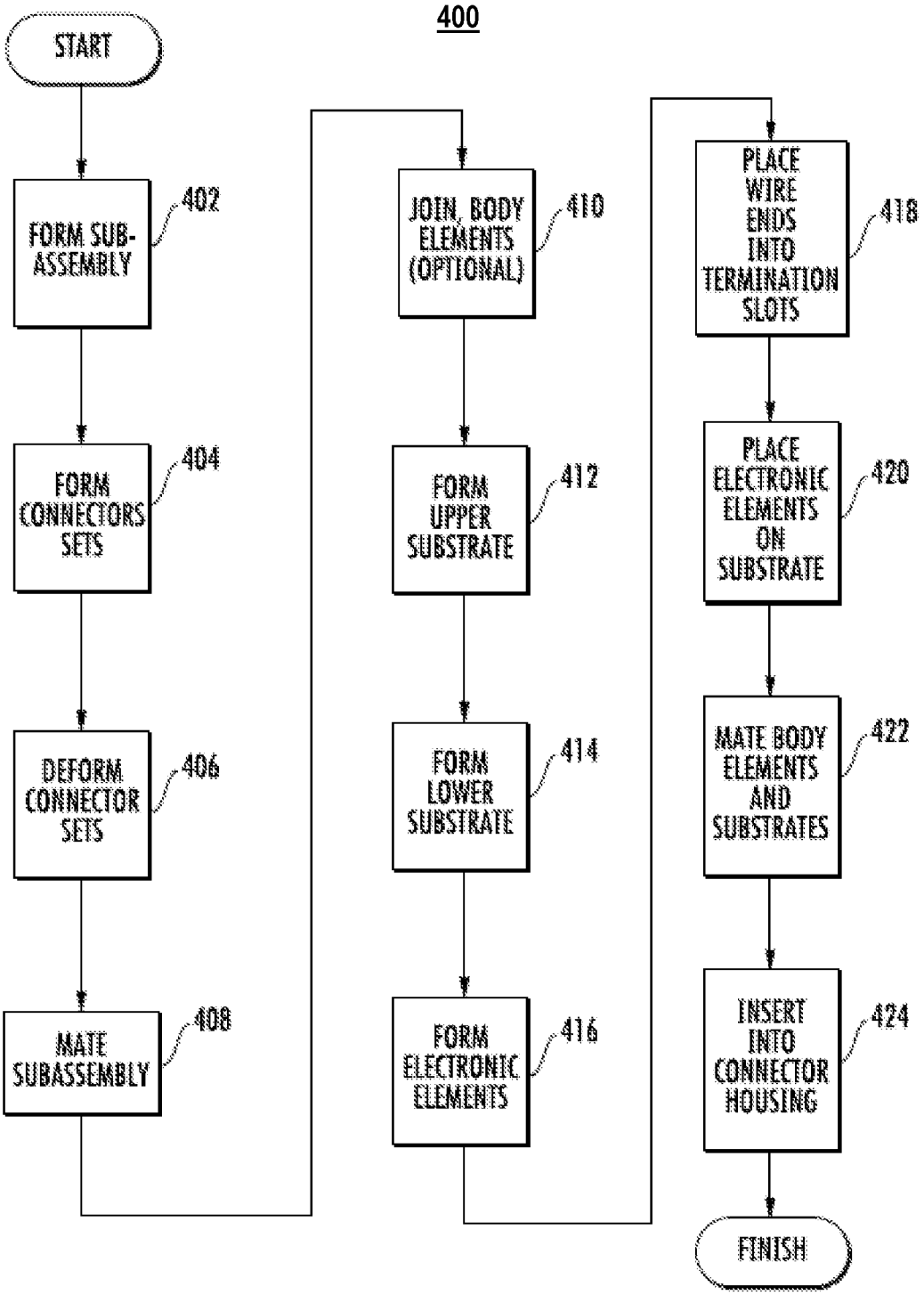
FIG. 4 is a logical flow diagram illustrating one exemplary embodiment of a method of manufacturing the connector assembly of FIGS. 1-3E in accordance with the principles of the present disclosure.

Referring now to FIG. 4, an exemplary embodiment of the method 400 of manufacturing, for example, the aforementioned connector insert assembly 100 illustrated with respect to FIGS. 1-1F, 2A-2E and 3-3E is shown and described in detail.

In the embodiment of FIG. 4, the method 400 generally comprises first forming the subassembly 101, 201 in step 402. The insert body assembly 101, 201 is preferably formed using an injection molding process of the type well known in the art, although other processes may be used. The exemplary injection molding process is chosen for its ability to accurately replicate small details of the mold, its low cost, and for its well-known ease of processing.

Next, two conductor sets (120*a*, 120*b*) are provided in step 404. As previously described, the conductor sets comprise metallic (e.g., copper or copper alloy) leadframes having a substantially square or rectangular cross-section and sized to fit within the slots of the connectors in the housing.

In step 406, the conductors are partitioned into sets; a first set 120*a* for use with a first connector recess of each port-pair (i.e., within the housing 302, and mating with the modular plug terminals), and a second set 120*b* for the other port in the port-pair. The conductors are formed to the desired shape(s) using a forming die or machine of the type well known in the art. Specifically, for the embodiment of FIG. 1, the first and second conductor sets 120*a*, 120*b* is deformed so as to produce the juxtaposed, substantially coplanar configuration.

In step 408, the first and second conductor sets 120*a*, 120*b* are insert-molded within the respective portions of the terminal insert assembly 129, thereby forming the terminal insert assemblies shown in, for example, FIG. 1 which was described in detail supra. Further, the two sub-components of the insert 129 are mated to the upper substrate 110, such as via a snap-fit, friction, an epoxy adhesive, thermal bonding, etc.

In step 410, the first and second insert body elements 102 of the connector insert assembly 101 formed via injection or transfer molding are bonded together. In one embodiment, a high-temperature polymer of the type ubiquitous in the art is used to form the insert body elements 102 although this is not required, and other materials (even non-polymers) may be used.

Per step 412, the upper substrate 110 is formed and perforated through its thickness with a number of apertures of predetermined size. Methods for forming substrates are well known in the electronic arts, and accordingly are not described further herein. Any conductive traces on the substrate required by the particular design are also added, such that necessary ones of the conductors, when received within the apertures, are in electrical communication with the traces.

Per step 414, the lower substrate 115 is formed and is perforated through its thickness with a number of apertures of predetermined size. Alternatively, the apertures may be formed at the time of formation of the substrate itself.

In step 416, one or more electronic components, such as the aforementioned toroidal transformers and chokes, chip chokes and other surface mount devices, are next formed and prepared (if used in the design). The manufacture and preparation of such electronic components is well known in the art, and accordingly is not described further herein.

In step 418, the wire wound ends of the wire wound electronic components formed in step 416 are inserted into the termination slots of the insert body element(s) where they are captured, for example, between the openings of upper substrate and aforementioned grooves. The same process may optionally be repeated for the lower substrate.

The relevant electronic components are then optionally mated to the upper substrate 110 in step 420. In one embodiment, one or more surface mount components are first positioned on the upper substrate, and the magnetics (e.g., toroids) positioned thereafter within the cavity of the insert body elements, although other sequences may be used. The components are electrically coupled to the PCB using a eutectic solder re-flow process as is well known in the art. In step 420, the remaining electrical components are disposed within the cavity of the insert body assembly 101 and wired electrically to the appropriate ones of the upper and/or lower termination slots.

In step 422, the assembled upper and lower substrates with optional surface mount electronic components are then mated with the terminal insert assembly, specifically such that the upper terminals 120*a* and lower terminals 120*b* are disposed in their corresponding desired position with respect to the upper substrate 110. The terminal assemblies 129 are then bonded to the substrate contacts via soldering or welding to ensure a rigid electrical connection for each terminal assembly to conductive pathways located on the substrate.

The completed insert connector assembly may be electrically tested to ensure proper operation if desired.

In step 424, the completed insert connector assembly is inserted into a connector housing via the use of a snap fit and the like. The connector housing is then surrounded with an EMI shield if desired, thereby forming the completed connector assembly.

With respect to the other embodiments described herein, the foregoing method may be modified as necessary to accommodate the additional components. Such modifications and alterations will be readily apparent to those of ordinary skill, given the disclosure provided herein.

It will be recognized that while certain aspects of the disclosure are described in terms of a specific sequence of steps of a method, these descriptions are only illustrative of the broader methods of the disclosure, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the present disclosure.

While the above detailed description has shown, described, and pointed out novel features of the disclosure as applied to various embodiments, it will be understood that various omissions, substitutions, and changes in the form and details of the device or process illustrated may be made by those skilled in the art without departing from the principles of the present disclosure. The foregoing description is of the best mode presently contemplated of carrying out the disclosure. This description is in no way meant to be limiting, but rather should be taken as illustrative of the general principles of the present disclosure. The scope of the invention should be determined with reference to the claims.

What is claimed is:

1. A connector assembly comprising:

a connector housing comprising a plurality of recesses each configured to receive at least a portion of a modular plug having a plurality of conductors disposed thereon;

a plurality of sets of conductors, the plurality of sets of conductors disposed at least partly within respective ones of the recesses, and the conductors configured to interface electrically with respective ones of the modular plug conductors;

an insert structure comprising a plurality of termination grooves having respective conductive ends of one or more electronic components disposed substantially in the termination grooves; and a substrate in signal communication with the plurality of sets of conductors, the substrate positioned adjacent the insert structure, the substrate comprising a plurality of conductive termination elements, each conductive termination element configured to align with respective ones of the plurality of termination grooves, the respective conductive ends of the one or more electronic components being terminated to the substrate via respective ones of the plurality of conductive termination elements;

wherein at least a portion of the conductive ends of the one or more electronic components resident within the termination grooves are sandwiched between the insert structure and the substrate.

2. The connector assembly of claim 1, wherein the respective conductive ends of the one or more electronic components are held within the termination grooves via the securing of the substrate adjacent to the termination grooves of the insert structure.

3. The connector assembly of claim 2, wherein the respective conductive ends of the one or more electronic components are in electrical communication with respective ones of the modular plug conductors to form an electrical pathway from the plurality of sets of conductors disposed at least partly within respective ones of the recesses to the one or more electronic components.

4. The connector assembly of claim 3, wherein the insert structure further comprises one or more posts, the one or more posts configured to secure the substrate to the insert structure.

5. The connector assembly of claim 4, wherein the one or more posts comprise one or more conductive terminals.

6. The connector assembly of claim 3, wherein the insert structure further comprises one or more lateral grooves, the one or more lateral grooves configured to interface with one or more respective features located on the connector housing.

7. The connector assembly of claim 1, wherein the termination grooves further comprise a conductive terminal disposed therein.

8. The connector assembly of claim 7, wherein at least a portion of the conductive ends of the one or more electronic components are sandwiched between the conductive terminals disposed within respective termination grooves and the substrate.

9. The connector assembly of claim 1, wherein at least a portion of the plurality of conductive termination elements on the substrate comprise a half-moon shaped termination.

10. The connector assembly of claim 9, wherein at least a portion of the conductive ends of the one or more electronic components are disposed within respective ones of the half-moon shaped terminations.

11. An insert structure assembly for use with a connector assembly, the insert structure assembly comprising:

an insert structure comprising:

a body element comprised of a polymer material and having an electronic component receiving cavity configured to have one or more electronic components disposed therein;

a plurality of conductive terminals; and a plurality of termination grooves disposed within at least a portion of the body element, the termination grooves configured to have a plurality of conductive ends of the one or more electronic components disposed substantially therein; and a substrate that is communication with the plurality of sets of conductors, the substrate positioned adjacent the insert structure, the substrate comprising a plurality of terminations disposed on a side surface thereof, the side surface being smaller in an area dimension than a top and a bottom surface of the substrate, each of the plurality of conductive ends of the one or more electronic components being terminated to the substrate via an electrical coupling to respective ones of the plurality of terminations.

12. The insert structure assembly of claim 11, wherein at least one of the plurality of terminations on the substrate comprises a half-moon shaped termination.

13. The insert structure assembly of claim 12, wherein at least one of the conductive ends of the one or more electronic components is disposed within the half-moon shaped termination.

14. A connector assembly comprising:

a connector housing comprising a plurality of recesses each configured to receive at least a portion of a modular plug having a plurality of conductors disposed thereon;

a plurality of sets of conductors, the plurality of sets of conductors disposed at least partly within respective ones of the recesses, and the conductors configured to interface electrically with respective ones of the modular plug conductors;

an insert structure comprising:

a body element having an electronic component receiving cavity with one or more electronic components disposed therein; and a plurality of termination grooves disposed within at least a portion of the body element, the termination grooves configured to have a plurality of conductive ends of the one or more electronic components disposed substantially therein; and a substrate in signal communication with the plurality of sets of conductors, the substrate positioned adjacent the insert structure, the substrate comprising a plurality of terminations disposed on a side surface thereof, the side surface being smaller in an area dimension than a top and a bottom surface of the substrate, each of the plurality of conductive ends of the one or more electronic components being terminated to the substrate via an electrical coupling to respective ones of the plurality of terminations.

15. The connector assembly of claim 14, wherein at least one of the plurality of terminations on the substrate comprises a half-moon shaped termination.

16. The connector assembly of claim 15, wherein at least one of the conductive ends of the one or more electronic components is disposed within the half-moon shaped termination.

17. The connector assembly of claim 14, wherein the substrate is positioned atop the insert structure and the electronic component receiving cavity comprises an opening disposed on a side surface of the body element.

18. The connector assembly of claim 17, wherein the plurality of termination grooves are disposed on the side surface of the body element.

* * * * *